US006704531B2

(12) United States Patent
Shin et al.

(10) Patent No.: US 6,704,531 B2
(45) Date of Patent: Mar. 9, 2004

(54) DEVELOPING SYSTEM HAVING METERING BLADE WITH SPACED INTERSECTING FACES

(75) Inventors: Joong-gwang Shin, Gyeonggi-do (KR); Geun-yong Park, Gyeonggi-do (KR); Yong-su Kim, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/252,053

(22) Filed: Sep. 23, 2002

(65) Prior Publication Data

US 2003/0133727 A1 Jul. 17, 2003

(30) Foreign Application Priority Data

Jan. 11, 2002 (KR) ..... 2002-1694

(51) Int. Cl.[7] ..... G03G 15/10
(52) U.S. Cl. ..... 399/237; 399/238
(58) Field of Search ..... 399/234, 233, 399/237–240, 248, 249, 274, 284

(56) References Cited

U.S. PATENT DOCUMENTS 5,561,264 A * 10/1996 Iino et al. ..... 399/240
5,937,253 A * 8/1999 Shimazaki et al. ..... 399/284
6,115,576 A * 9/2000 Nakano et al. ..... 399/237
6,184,909 B1 * 2/2001 Matsuno et al. ..... 399/233
6,389,253 B1 * 5/2002 Nonomura et al. ..... 399/149
2002/0159794 A1 * 10/2002 Nakashima et al. ..... 399/237

FOREIGN PATENT DOCUMENTS

JP 2000162877 A * 6/2000 ..... G03G/15/10
JP 2001-324876 11/2001

* cited by examiner

*Primary Examiner*—William J. Royer
(74) *Attorney, Agent, or Firm*—Staas & Halsey LLP

(57) ABSTRACT

A developing system of a liquid electrophotographic image forming device. The developing system includes a development container in which a developer is stored, a development roller which rotates opposite to a photosensitive body, and being partially soaked in the development container, and a metering blade. The metering blade has a first face contacting the circumference of the development roller and a second face by which a predetermined angle is formed with respect to the first face, which maintains a developer layer on the circumference of the development roller at a predetermined thickness. By optimizing related parameters of the metering blade, the developer layer on the development roller can be regulated, thereby achieving good image quality.

23 Claims, 4 Drawing Sheets

DEVELOPING SYSTEM HAVING METERING BLADE WITH SPACED INTERSECTING FACES

CROSS-REFERENCE TO RELATED APPLICATIONS

This application claims the benefit of Korean Application No. 2002-1694, filed Jan. 11, 2002, in the Korean Industrial Property Office, the disclosure of which is incorporated herein by reference.

BACKGROUND OF THE INVENTION

1. Field of the Invention

The present invention relates to a developing system of a liquid electrophotographic image forming device, and more particularly, to a developing system capable of regulating a developer layer on a development roller of a liquid electrophotographic image forming device using a high-concentration liquid developer.

2. Description of the Related Art

In general, developing systems of liquid electrophotographic image forming devices form an electrostatic latent image corresponding to a desired image by scanning light on a photosensitive body, develop the electrostatic latent image using a developer in which powder-shaped toner is mixed with a liquid solvent, and print the developed electrostatic latent image on a paper.

FIG. 1 is an example of a conventional developing system of a liquid electrophotographic image forming device. Referring to FIG. 1, the conventional developing system of a liquid electrophotographic image forming device includes a photosensitive body 10 which is supported by a plurality of rollers 11 and moves as an endless track, a developing unit 20 to develop an electrostatic latent image formed on the photosensitive body 10, and a transfer unit 30 to transfer the electrostatic latent image onto a paper P.

The photosensitive body 10 is charged to a predetermined electric potential by a charger 12, and the charged electric potential varies depending on light beams scanned by a laser scanning unit (LSU) 13 installed adjacent to the photosensitive body 10 such that the electrostatic latent image is formed. Next, the electrostatic latent image formed on the photosensitive body 10 is developed by the developing unit 20, and the developed image is transferred onto a transfer roller 14 and is printed onto the paper P passing through the transfer roller 14 and a fusing roller 15.

The structure of the developing unit 20 is shown in FIG. 2. Referring to FIG. 2, the developing unit 20 develops the electrostatic latent image formed on the photosensitive body 10 using a developer to form an image. The developing unit 20 includes a development roller 23 that is installed to be rotatable in a main body 21, a manifold 22 to spray the developer between the development roller 23 and the photosensitive body 10, and a squeeze roller 24. Reference numerals 25, 26, and 27 denote a cleaning roller to clean the surface of the development roller 23, a development backup roller, and a squeeze backup roller, respectively.

In the structure of FIG. 2, the electrostatic latent image formed on the photosensitive body 10 is developed using a liquid developer that is sprayed between the development roller 23 and the photosensitive body 10 by the manifold 22, and a liquid carrier left on the photosensitive body 10 is removed with the squeeze roller 24.

A low-concentration liquid developer (less than 2.5–3% solid) is used in the developing system of a liquid electrophotographic image forming device, thereby obtaining a high quality image. However, since the concentration of the developer in an ink cartridge (not shown) to supply the developer to the developing system is 25% solid, a complicated developer supplying unit is required to change the high-concentration developer to the low-concentration developer. Thus, the size of the image forming device increases, and the image forming device has a complicated structure. Also, after development of the image, a system to control the concentration of the liquid developer depending on variations in the toner particles is required when the developer is refilled.

Thus, in order to solve these problems, a new developing system using a high-concentration developer greater than 3% solid is required. A developer layer on the development roller should be regulated regardless of the concentration of the developer.

SUMMARY OF THE INVENTION

Accordingly, it is an object of the present invention to provide a developing system for a high-concentration liquid electrophotographic image forming device, which is capable of improving the quality of an image by regulating a developer layer on a development roller.

Additional objects and advantages of the invention will be set forth in part in the description which follows and, in part, will be obvious from the description, or may be learned by practice of the invention.

The foregoing and other objects of the present invention are achieved by providing a developing system of a liquid electrophotographic image forming device. The developing system includes a development container in which a developer is stored; a photosensitive body; a development roller to rotate opposite to the photosensitive body, the development roller being partially soaked in the developer in development container; and a metering blade to maintain a layer of the developer on the development roller at a constant thickness, the metering blade including a first face contacting the development roller, and a second face forming an angle with respect to the first face, wherein a point at which the development roller contacts the first face of the metering blade is spaced from an edge at which the first and second faces intersect.

According to an aspect of the present invention, the metering blade is an L-shaped metal plate.

According to another aspect of the present invention, the point at which the circumference of the development roller contacts the first face of the metering blade is spaced more than 1 mm apart from the edge, and a force per centimeter applied to the circumference of the development roller by the metering blade is about 100–200 gf/cm.

According to still another aspect of the present invention, surface roughness of the metering blade is less than 0.5 $\mu$m, and an angle between the first face and the second face of the metering blade is about 90 degrees.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
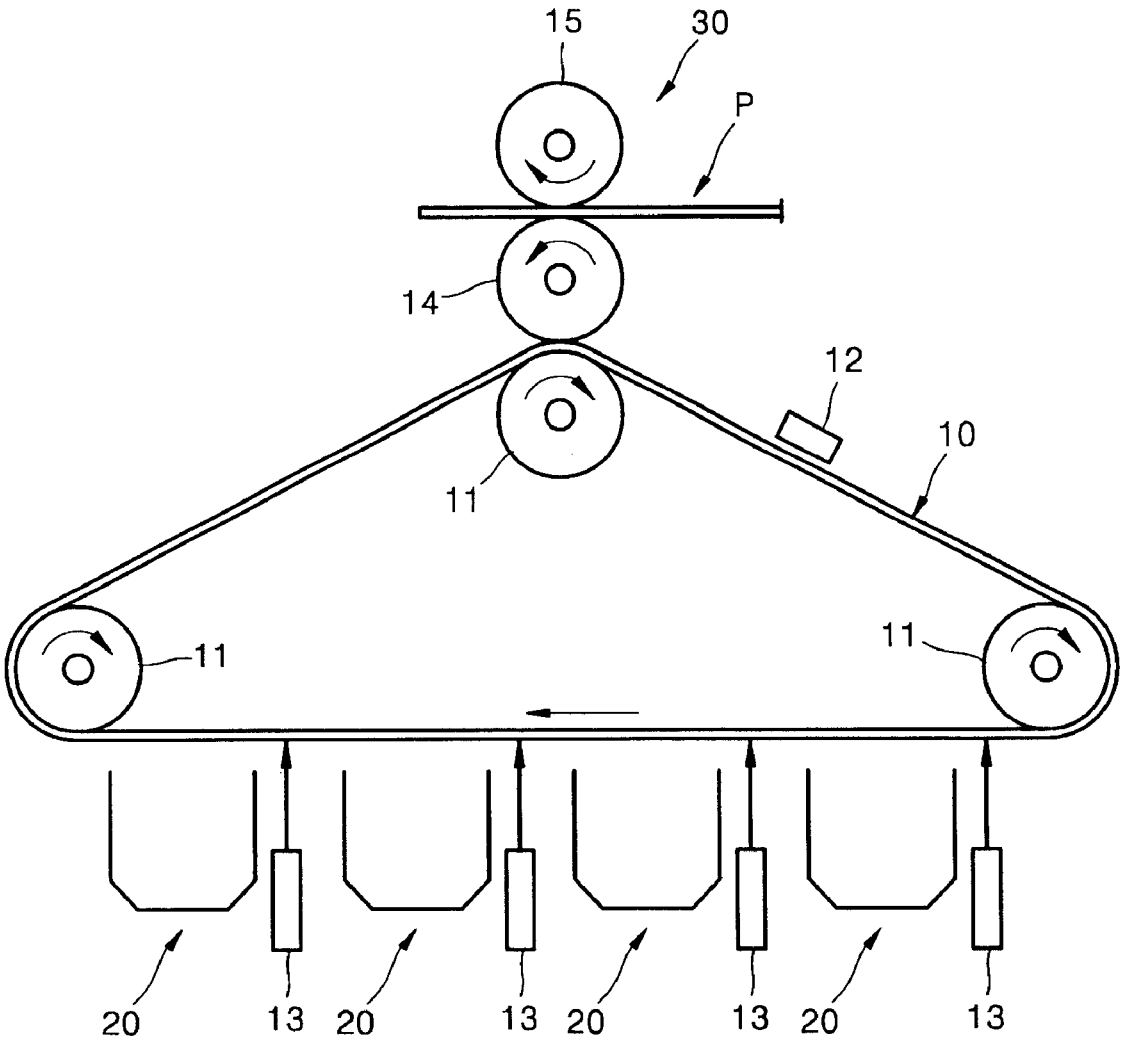
FIG. 1 (PRIOR ART)
FIG. 1 illustrates a conventional developing system of a liquid electrophotographic image forming device.
Figure 2:
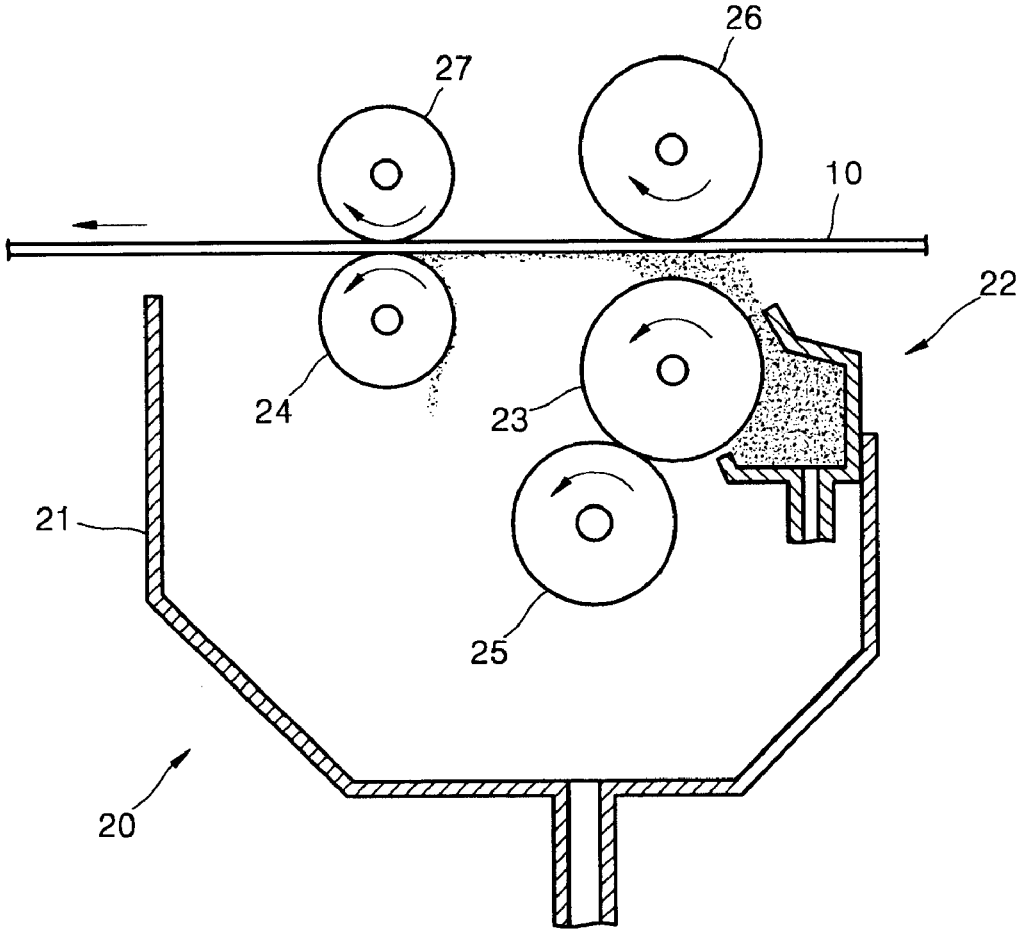
FIG. 2 (PRIOR ART)
FIG. 2 illustrates the structure of a developing unit of FIG. 1.

Reference will now be made in detail to the present preferred embodiments of the present invention, examples of which are illustrated in the accompanying drawings, wherein like reference numerals refer to like elements throughout.

Figure 3:
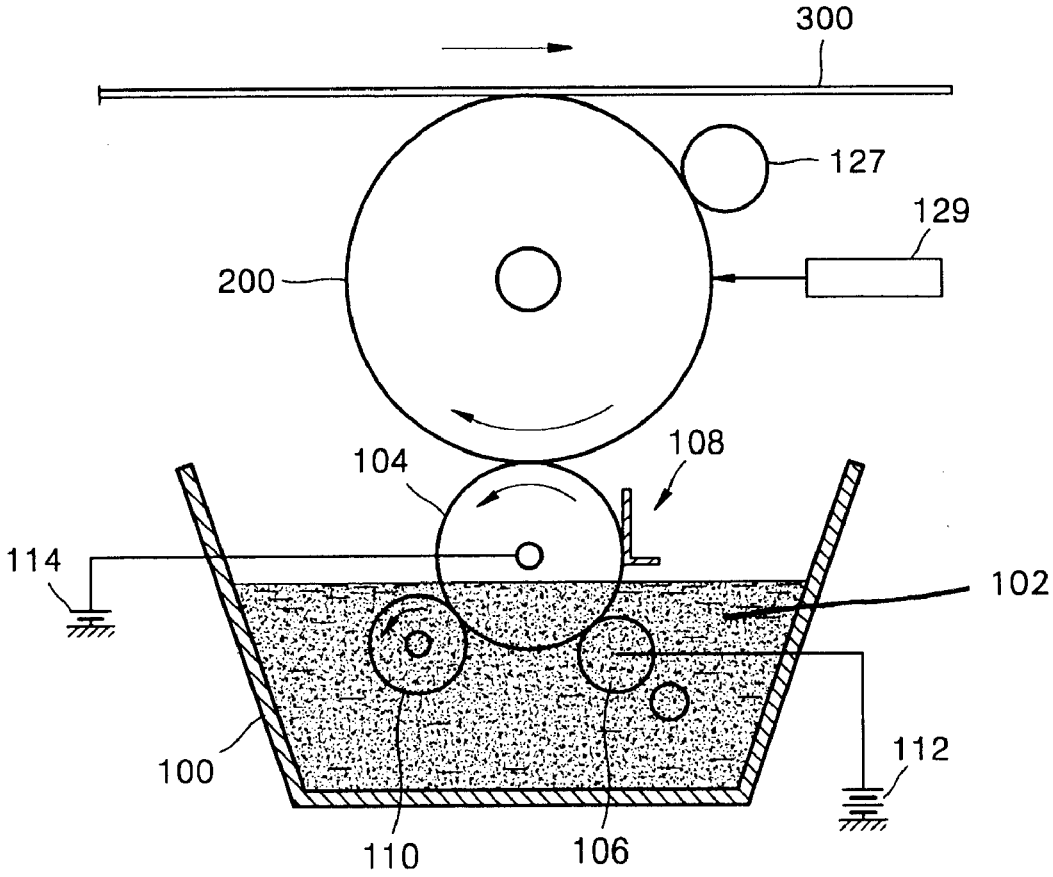
FIG. 3 illustrates a developing system of a liquid electrophotographic image forming device according to an embodiment of the present invention.

FIG. 3 illustrates a developing system of a liquid electrophotographic image forming device according to an embodiment of the present invention. Referring to FIG. 3, the developing system of a liquid electrophotographic image forming device includes a development container 100 to which a developer 102 is supplied from a developer cartridge (not shown). Here, a high-concentration liquid developer of about 3–40% solid is used as the developer 102 supplied to the development container 100.

Within the development container 100 there is a development roller 104 to rotate opposite to a photosensitive body 200. The development roller 104 is partially soaked in the developer 102. Within the development container 100, there further is a metering blade 108 to maintain a developer layer stained on the circumference of the development roller 104 at a predetermined thickness, a depositing roller 106 to apply an electric potential to attach the developer 102 to the circumference of the development roller 104, and a cleaning roller 110 to clean the surface of the development roller 104. In FIG. 3, reference numerals 114 and 112 denote a development power supply portion to apply a development voltage to the development roller 104, and a depositing power supply portion to apply a voltage to the depositing roller 106, respectively. Reference numerals 127, 129, and 300 respectively denote a charging roller to charge the photosensitive body 200, a laser scanning unit (LSU) to form an electrostatic image by scanning light onto the photosensitive body 200, and a transfer medium onto which the electrostatic latent image that is developed on the photosensitive body 200 is transferred, to print the transferred image onto a paper.

The development roller 104 may be formed of polyurethane rubber or NBR as a conductive elastomer, having a resistance of about $10^5$–$10^8$ ohm, a hardness of shore A 25–65 degrees, and a surface roughness of Ra 1–4 $\mu$m.

The metering blade 108 regulates the thickness and the concentration of the developer layer stained on the development roller 104 by applying a predetermined pressure to the circumference of the development roller 104.

The depositing roller 106 attaches the developer 102 to the development roller 104 by an electric force of a voltage applied from the depositing power supply portion 112. In this case, the depositing roller 106 may contact the development roller 104 or may be spaced at a predetermined distance apart from the development roller 104.

The cleaning roller 110 rotates to contact the development roller 104 in the same direction as the development roller 104 and cleans the developer 102 stained on the development roller 104 which is not developed.

Only one developing system is provided in the image forming device shown in FIG. 3. However, to form a multi-colored image, a plurality of the developing systems may be provided.

In order to perform a development operation, the developer 102 for each color is supplied to the development container 100 from the developer cartridge (not shown) and is charged to a predetermined level. In this case, the charged developer 102 is a high-concentration developer having a concentration greater than 20% solid. Voltages of about 300–550 V and about 500–1500 V are applied to the development roller 104 and to the depositing roller 106, respectively. If the voltages are applied to the development roller 104 and to the depositing roller 106 in this way, toner particles of the developer 102 are positively charged, and thus the developer 102 attaches to the surface of the development roller 104 due to a voltage difference between the development roller 104 and the depositing roller 106. In this case, the amount of the developer 102 that attaches to the development roller 104 is larger than the amount required to develop the electrostatic latent image formed on the photosensitive body 200, and a toner is stained in a region outside of the area of the electrostatic latent image.

Figure 4:
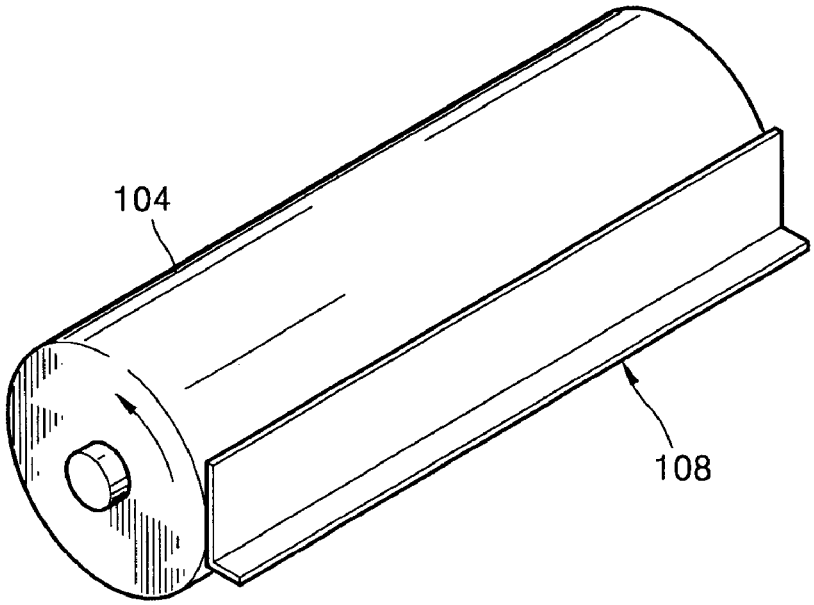
FIG. 4 is a perspective view of a metering blade to regulate a developer layer on a development roller of FIG. 3.
Figure 5:
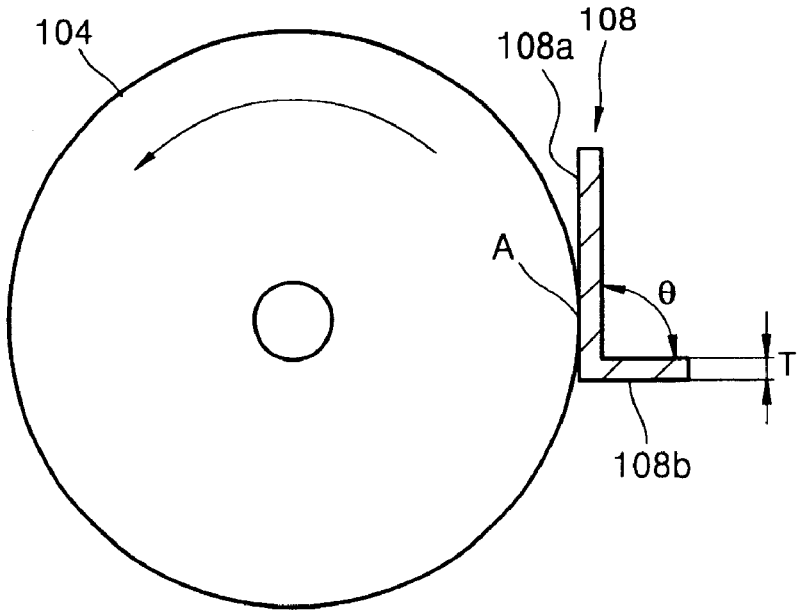
FIG. 5 is a top view of the metering blade of FIG. 4.

Accordingly, the metering blade 108 maintains the developer layer stained on the surface of the development roller 104 at a predetermined thickness. In the present invention, as shown in FIGS. 4 and 5, the metering blade 108 is an L-shaped metal plate and includes a first face 108*a* contacting the circumference of the development roller 104, and a second face 108*b* formed at an angle with respect to the first face 108*a*.

The developer layer stained on the development roller 104 differs depending on parameters such as a point A at which the metering blade 108 contacts the development roller 104, pressure applied to the metering blade 108, surface roughness of the metering blade 108, and an angle θ between the first face 108*a* and the second face 108*b*. Thus, it is very important to optimize these parameters, as discussed below.

First, the point A is spaced more than 1 mm apart from an edge at which the first and second faces 108*a* and 108*b* intersect. In particular, the best developer layer was obtained at a point A spaced 1–2 mm apart from the edge. The developer layer on the development roller 104 becomes nonuniform when the point A is spaced less than 1 mm from the edge.

Second, according to an aspect of the present invention, a force per centimeter applied to the circumference of the development roller 104 by the metering blade 108 is 100–200 gf/cm. In particular, the best result was obtained when the pressure is 150 gf/cm. In this case, a thickness T of the metering blade 108 is 0.08 mm. When the pressure applied to the circumference of the development roller 104 by the metering blade 108 is too strong, the developer layer on the development roller 104 becomes nonuniform.

Third, the best result was obtained when the surface roughness Rz of the metering blade 108 is less than 0.5 $\mu$m. Fourth, the best result was obtained when the angle θ between the first face 108*a* and the second face 108*b* of the metering blade 108 is about 90 degrees. The developer layer on the development roller 104 becomes nonuniform at more than 90 degrees.

If these optimized parameters are applied to the developing system, the most uniform developer layer on the development roller 104 can be obtained. Thus, even though the developer 102 in a wide range of about 3–20% solid is used in the developing system, the concentration before a development operation can be maintained in a nearly uniform state and can be used in the development operation.

Subsequently, after the electrostatic latent image formed on the photosensitive body 200 is developed, the developer 102 left on the development roller 104 is removed using the cleaning roller 110.

As described above, by applying these optimized parameters to the developing system of a liquid electrophotographic image forming device according to the present invention, even though the high-concentration developer in a wide range of concentrations is used, the developer layer on the development roller can be regulated, thereby achieving good image quality.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A developing system of a liquid electrophotographic image forming device, comprising:

a development container in which a developer is stored;

a photosensitive body;

a development roller to rotate opposite to the photosensitive body, the development roller being partially soaked in the developer in the development container; and a metering blade to maintain a layer of the developer on the development roller at a constant thickness, the metering blade comprising:

a first face in contact with the development roller, and a second face forming an angle with respect to the first face, wherein a point at which the development roller contacts the first face of the metering blade is spaced from an edge at which the first and second faces intersect, and a concentration of the developer is 3–40% solid.

2. The system of claim 1, wherein the metering blade is an L-shaped metal plate.

3. The system of claim 2, wherein the point at which the development roller contacts the first face of the metering blade is spaced more than 1 mm apart from the edge.

4. The system of claim 3, wherein a force per centimeter applied to the development roller by the metering blade is 100–200 gf/cm.

5. The system of claim 4, wherein a surface roughness of the metering blade is less than 0.5 $\mu$m.

6. The system of claim 5, wherein the angle between the first face and the second face of the metering blade is 90 degrees.

7. The system of claim 3, wherein a surface roughness of the metering blade is substantially less than 0.5 $\mu$m.

8. The system of claim 3, wherein the angle between the first face and the second face of the metering blade is 90 degrees.

9. The system of claim 1, wherein the point at which the development roller contacts the first face of the metering blade is spaced more than 1 mm from the edge.

10. The system of claim 9, wherein a force per centimeter applied to the development roller by the metering blade is 100–200 gf/cm.

11. The system of claim 10, wherein a surface roughness of the metering blade is less than 0.5 $\mu$m.

12. The system of claim 11, wherein the angle between the first face and the second face of the metering blade is 90 degrees.

13. The system of claim 9, wherein a surface roughness of the metering blade is less than 0.5 $\mu$m.

14. The system of claim 9, wherein the angle between the first face and the second face of the metering blade is 90 degrees.

15. A developing system of a liquid electrophotographic image forming device, comprising:

a photosensitive body;

a development roller to transfer a developer to the photosensitive body; and a blade to maintain a layer of the developer on the development roller at a constant thickness, the blade comprising:

a first face in contact with the development roller at a point of contact, and a second face intersecting the first face at a point of intersection spaced from the point of contact, wherein a concentration of the developer is 3–40% solid.

16. The system of claim 15, wherein an angle between the first and second faces is 90 degrees.

17. The system of claim 15, further comprising a development container in which the developer is stored, the development roller being partially soaked in the developer in the development container.

18. The system of claim 15, wherein the development roller is formed of polyurethane rubber or NBR.

19. The system of claim 15, wherein the development roller has a resistance of $10^5$–$10^8$ ohm, a hardness of shore A 25–65 degrees, and a surface roughness of 1–4 $\mu$m.

20. The system of claim 15, further comprising:

a depositing roller to attach the developer to the development roller; and a depositing power supply to apply a voltage to the depositing roller to attach the developer thereto.

21. The system of claim 15, wherein the point of intersection is spaced 1–2 mm from the point of contact.

22. The system of claim 15, wherein a surface roughness of the development roller is 1–4 $\mu$m.

23. The system of claim 15, wherein the blade applies a pressure of 100–200 gf/cm to the development roller.

* * * * *